United States Patent [19]

Hagan

[11] Patent Number: 4,671,405

[45] Date of Patent: Jun. 9, 1987

[54] SHIPPING CONTAINER

[76] Inventor: Randall B. Hagan, 1526 Cardinal Cir., Sapulpa, Okla. 74066

[21] Appl. No.: 764,136

[22] Filed: Aug. 9, 1985

[51] Int. Cl.[4] ..... B65D 75/00

[52] U.S. Cl. ..... 206/139; 206/499; 206/503; 206/509; 217/19; 217/21; 220/20; 220/21; 220/22; 220/23.86; 24/591

[58] Field of Search ..... 206/139, 203, 386, 427, 206/499, 509, 503; 217/19, 20, 21; 220/4 C, 4 D, 21, 20, 20.5, 22, 23.86; 24/590, 591

[56] References Cited

U.S. PATENT DOCUMENTS

| | | | |
|---|---|---|---|
| D. 139,222 | 10/1944 | Garfunkle | 220/4 C |
| 2,110,434 | 3/1938 | Albin | 24/591 |
| 2,243,625 | 5/1941 | Gettelman | 206/139 |
| 2,574,983 | 11/1951 | Reed | 206/139 |
| 2,725,087 | 11/1955 | Potter | 206/598 |
| 3,154,209 | 10/1964 | Wilhite et al. | 217/21 |
| 3,184,071 | 5/1965 | Delaire | 220/21 |
| 3,502,237 | 3/1970 | Verhein et al. | 206/598 |
| 3,744,665 | 7/1973 | Spoto | 220/21 |
| 3,773,213 | 11/1973 | Frederick | 206/509 |
| 3,919,379 | 11/1975 | Smarook | 206/139 |
| 3,972,441 | 8/1976 | Prodel | 206/139 |
| 4,132,311 | 1/1979 | Glinert | 206/387 |
| 4,135,729 | 1/1979 | Brangenburg | 24/590 |
| 4,176,747 | 12/1979 | Aho | 206/509 |
| 4,284,189 | 8/1981 | Vamvakas | 206/139 |
| 4,342,139 | 8/1982 | Tanaka | 24/591 |
| 4,529,088 | 7/1985 | Quong | 220/21 |
| 4,549,656 | 10/1985 | Barnes et al. | 220/21 |

FOREIGN PATENT DOCUMENTS

| | | | |
|---|---|---|---|
| 16115 | 6/1894 | United Kingdom | 217/21 |

*Primary Examiner*—Joseph Man-Fu Moy
*Assistant Examiner*—David T. Fidei
*Attorney, Agent, or Firm*—Head, Johnson & Stevenson

[57] ABSTRACT

A shipping container for glass bottles or other articles of uniform size and height, the container being formed of an upright structure of generally rectangular horizontal cross-sectional configuration and having internal partitions providing a plurality of vertical, loading columns extending from the bottom to the top, the structure having spaced apart horizontal slots extending from the front to the back, the spacing between the slots being slightly greater than the height of the articles for which the container is configured, and a plurality of trays, one being received in each of the slots, the trays being moveable to a loading position allowing articles to be inserted in each of the columns in the top until the bottom tray is filled, after which the next tray adjacent to the bottom is closed and additional articles inserted until, in sequence, each section between trays is filled. The structure is unloaded by moving the trays in sequence to the unloading position, starting with the bottom tray, allowing the articles to drop through the columns and out the bottom of the container.

8 Claims, 11 Drawing Figures

SHIPPING CONTAINER

SUMMARY OF THE INVENTION

Fragile articles, such as glass bottles, are difficult to pack for shipment, such as from a manufacturer to a bottling plant. The bottles must be shipped in bulk quantity and must be expeditiously loaded and unloaded with minimal manual handling. The present invention is directed towards a shipping container of the type which greatly facilitates loading and unloading fragile articles.

For background information as to structures of a similar nature, reference may be had to the following U.S. Pat. Nos. : 3,586,206; 981,744; 4,142,634; 2,361,077; and 4,476,988.

In the present invention, a shipping container for glass bottles or other articles of uniform size and height is provided in the form of an upright structure of generally rectangular horizontal cross-sectional configuration. The structure has a bottom, a top, a front, a back and two sides. The structure has internal partitions providing a plurality of vertical loading columns which extend from the open top to the open bottom. In a preferred arrangement the structure is formed of a plurality of horizontal segments, each segment providing a portion of the structure front, back and two sides, there being a bottom segment and a top segment and a plurality of intermediate segments. The height of each segment is slightly greater than the height of the articles for which the container is designed and each segment has internal partitions providing, when the segments are stacked in alignment, vertical loading columns.

The structure has provision for trays positionable in horizontal slots and, when the structure is formed of horizontal segments, the trays are moveable in slots between the segments. Each tray is moveable between a closed and an open position. In the closed position each tray blocks the vertical loading columns in the structure and in the open position of the trays, the columns are unobstructed.

Preferably, the bottom of the structure includes provision for receiving the tines of a fork lift truck.

To load the structure the bottom tray is positioned in closed position, thereby closing off the bottom end of the vertical columns. Articles can be then inserted into each of the exposed upper ends of each column, the articles passing downwardly through the structure and resting on the bottom tray. After an article has been positioned in each column in contact with the bottom tray, the tray next upwardly from the bottom tray is moved to the closed position and the sequence repeated until each segment of the structure is filled with an article. The top most tray is then moved to the closed position, closing the top of the structure.

Provision is made to lock the trays in the loading position.

To unload the structure, the structure is raised above a loading surface, such as a padded conveyor belt. The lowermost tray is moved to the open position, allowing the articles to pass freely downwardly therethrough engaging the padded conveyor. The articles will be free to bounce within the lower end of the columns. The structure is then moved upwardly allowing the articles which have been discharged to clear the bottom structure as they are moved away by the moving conveyor belt. The structure is then lowered again and the tray next upwardly from the bottom tray is moved to the open position, allowing the second segment to discharge its contents. This sequence is repeated until all of the trays have been moved, in sequence, to the open position and the structure thereby completely emptied of the articles.

The structure is preferably formed of segments made of molded plastic material and held together by bolts.

More details of a preferred embodiment of the invention will be set forth in the following description and claims, taken in conjunction with the attached drawings.

DETAILED DESCRIPTION OF THE PREFERRED EMBODIMENT OF THE INVENTION

Figure 1:
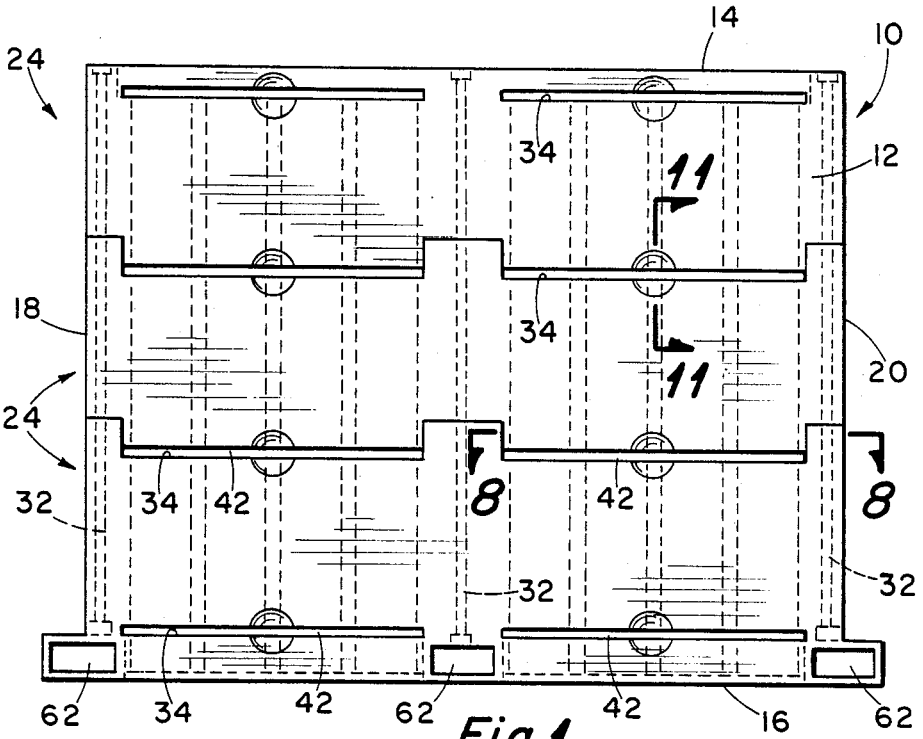
FIG. 1 is a front elevational view of an embodiment of the invention providing a shipping container having three segments.
Figure 2:
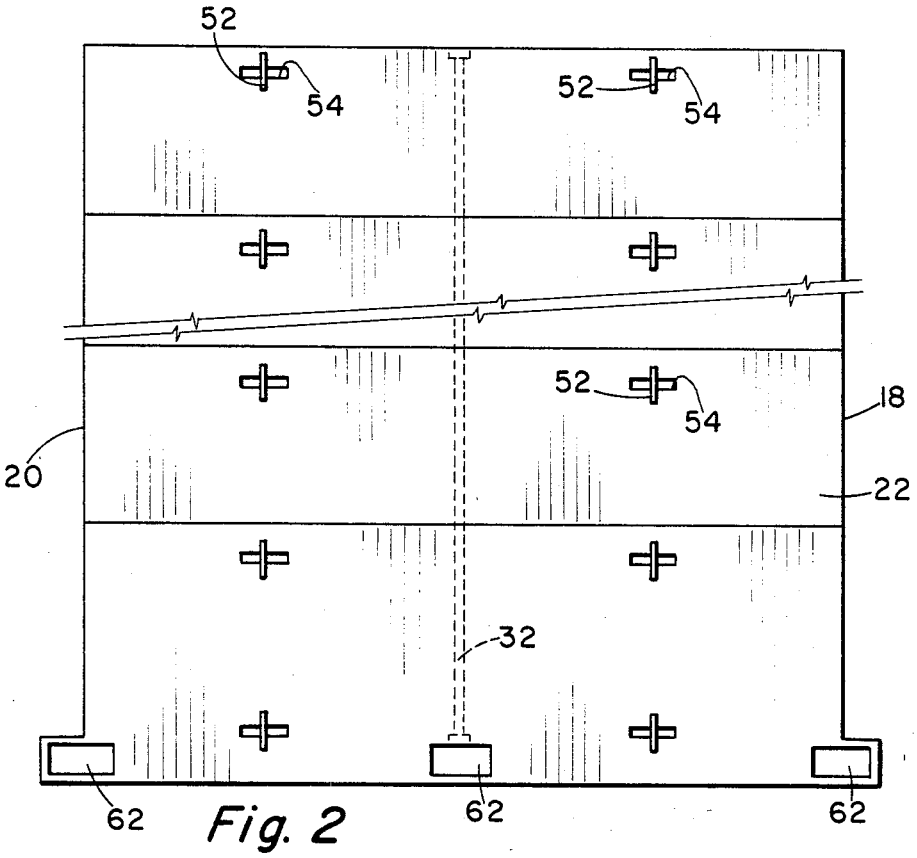
FIG. 2 is a rear elevational view of a shipping container but showing one having four or more segments.

Referring to the drawings and first to FIG. 1 a shipping container is indicated generally by the numeral 10. The container has a front 12, a top 14, a bottom 16, a first side wall 18 and a second side wall 20. The structure 10 is upright and is of generally rectangular horizontal cross-sectional configuration. FIG. 2 shows the back 22 of the structure, although the structure of FIG. 2 has more segments than that of FIG. 1, otherwise the illustration of the invention in FIG. 1 and FIG. 2 is the same.

Figure 4:
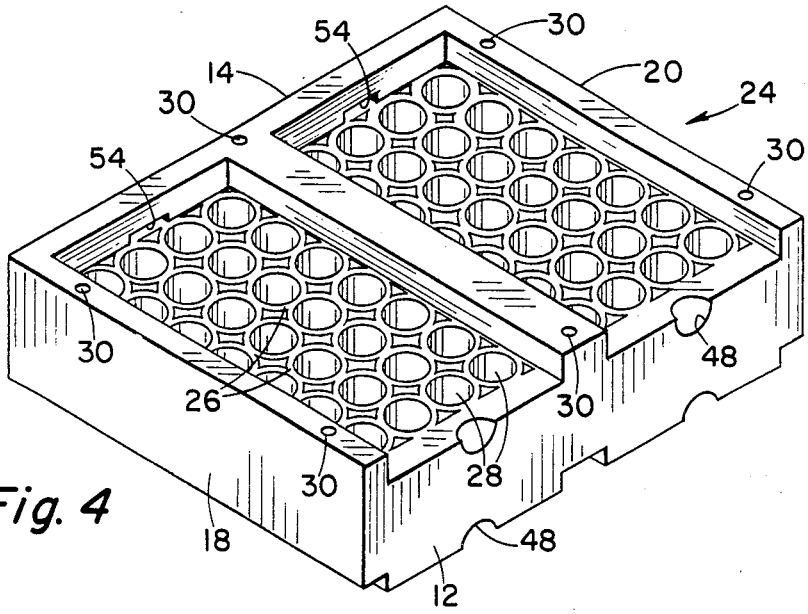
FIG. 4 is an isometric view of a segment formed of molded plastic as may be employed in assemblying a shipping container according to the invention.

While the container may be made of a unitary device a preferred arrangement employs a construction formed of a plurality of segments generally indicated by the numeral 24 in FIG. 4. Each segment is preferably made of molded plastic and each segment provides a portion of the front, back and sides of the shipping container. Each of the intermediate segments of a shipping container may be identical with a slightly varied design for the top and bottom segments as will be apparent from FIGS. 1 and 2.

Figure 5:
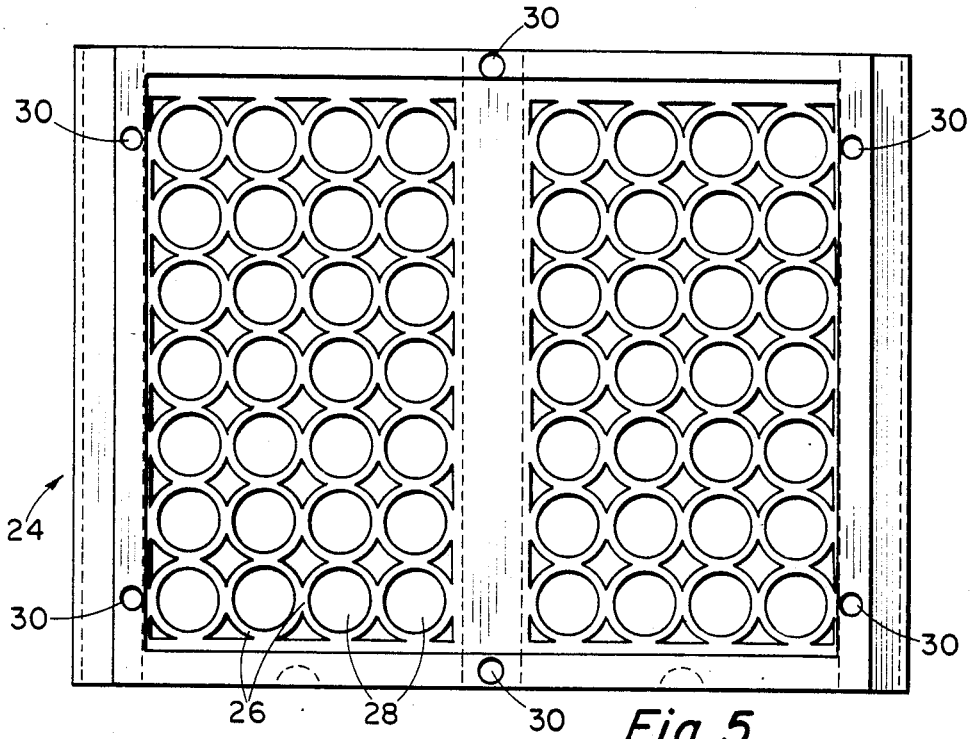
FIG. 5 is a top plan view of the molded segment of FIG. 4.

Each segment, whether an intermediate segment as is illustrated in FIGS. 4 and 5, or a top and bottom segment, is of uniform external dimensions and each has partitions 26 therein dividing the interior of the container into a plurality of vertical loading columns 28. The horizontal cross-sectional configuration of the interior of each loading column 28 will be determined by the article to be shipped in the container. When the articles are glass bottles the column 28 will preferably be configured to loosely yet freely slidably receive the glass bottles. While the partitions 26 and loading column 28 are configured to provide loading columns having a circular interior cross-sectional configuration it can be seen that the partitions may provide loading columns of square, hexagonal or other cross-sectional configurations, if desired.

Figure 3:
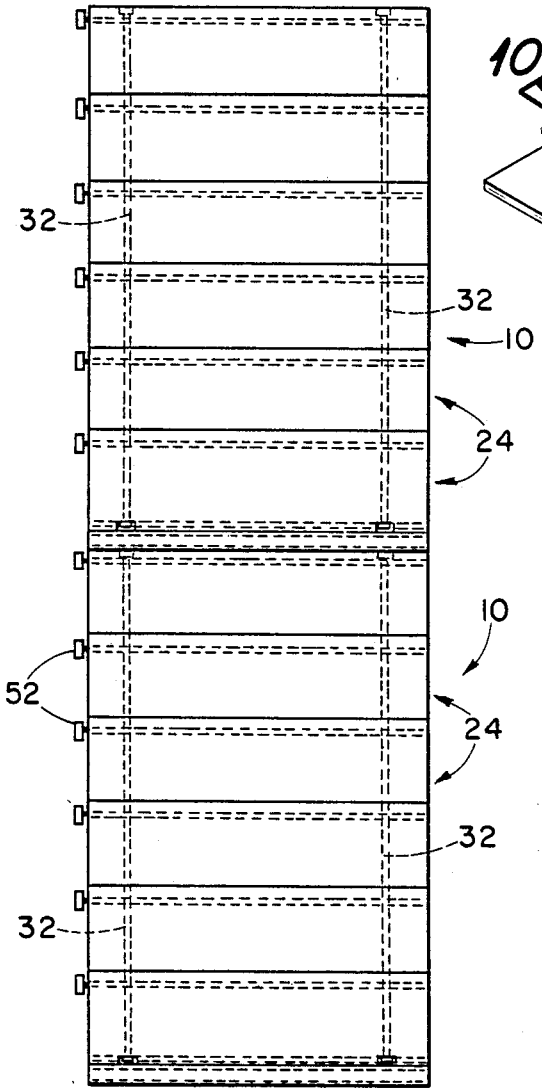
FIG. 3 is an elevational side view of the invention showing two shipping containers, one stacked on top of the other. Each of the containers in FIG. 3 has six segments.

FIG. 3 shows a side view of two separate containers 10, one stacked on top of the other, to show that the containers are configured to be stackable.

Each of the segments 24 has holes 30 therein, there being a total of six holes in each segment by example, which, when the segments are stacked in alignment, receive elongated bolts 32 seen in dotted outline in FIGS. 1 and 3. Each bolt 32 has a head on one end and receives a nut on the other so that after the segments are stacked the bolts may be inserted and the nuts tightened to retain the segments into a unitary shipping container.

Figure 6:
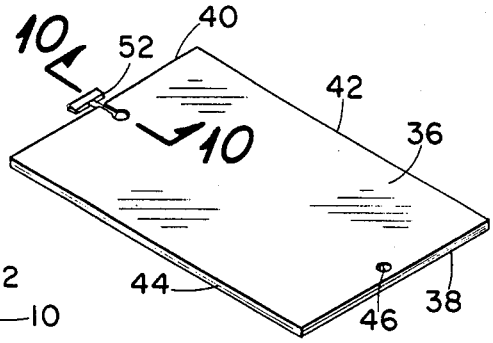
FIG. 6 is an isometric of a tray as employed in the invention.
Figure 11:
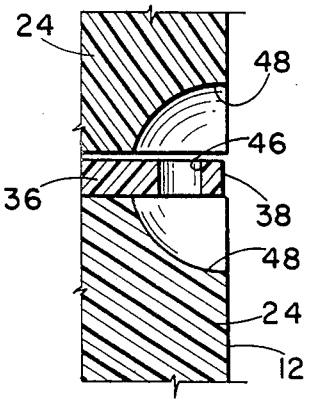
FIG. 11 is a fragmented cross-sectional view of the front portion of a shipping container as taken along the lines 11-11 of FIG. 1 showing a recess in the front portion for each of the trays providing means for moving the trays from the closed to the opened position and vice versa.

The shipping container is arranged to provide slots 34 adjacent the top 14 of the container, adjacent the bottom 16 of the container and between each intermediate segment 24 of the container. Each of the slots 34 is open in front 12 and each slot receives a tray 36, one embodiment of which is illustrated in FIG. 6. The tray 36 has a front edge 38, a rear edge 40 and opposed side edges 42 and 44. Adjacent the front edge 38 is a hole 46 to facilitate manual movement of the tray between open and closed positions. As shown in FIG. 11 the segments are provided with hand recesses 48 so that the trays 46 may be easily grasped for movement thereof, but permitting the front edge 38 of the tray to be confined, when the tray is in the closed position, within the confines of the front surface 12 of the container.

Figure 7:
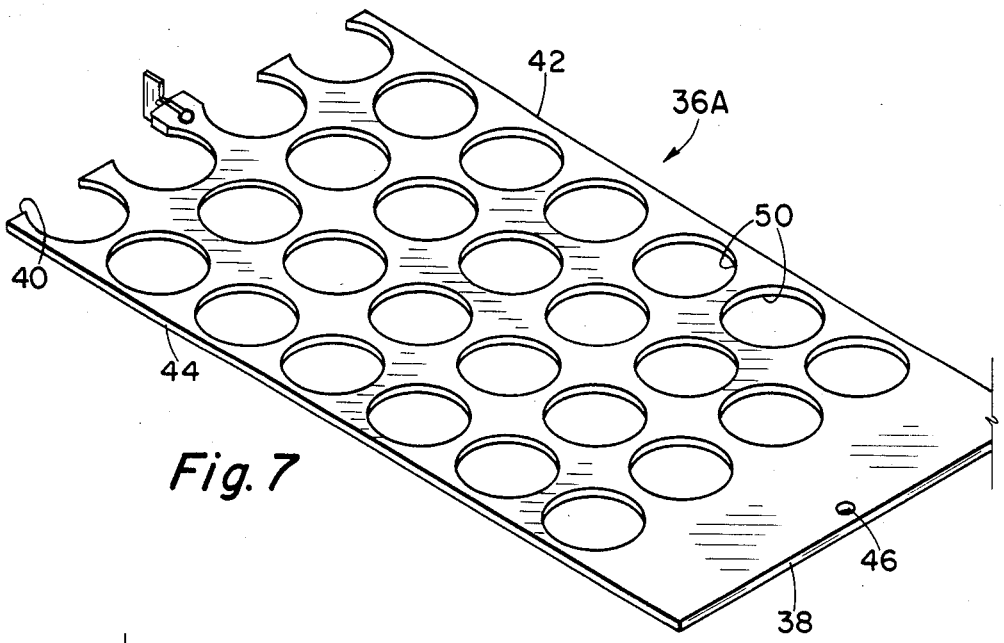
FIG. 7 is an enlarged isometric view of an alternate embodiment of a tray which may be employed in the invention.
Figure 8:
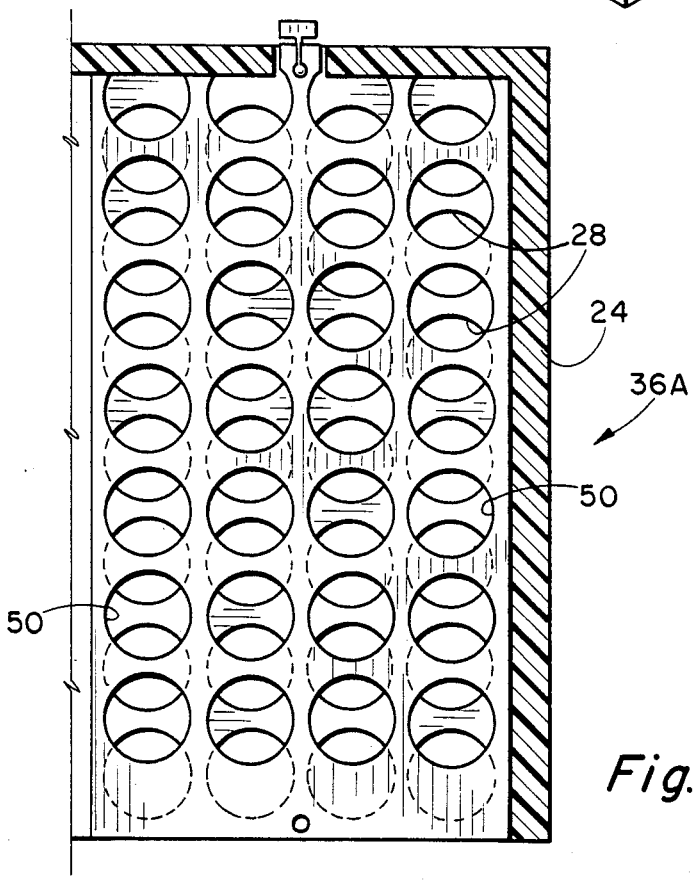
FIG. 8 is a partial cross-sectional view as taken along the line 8—8 of FIG. 1 showing the use of the tray of FIG. 7 and showing the tray in the closed position.

An alternate embodiment of the tray 36 is shown in FIGS. 7 and 8, and is identified by the numeral 36A. The alternate embodiment is different only in that the tray is provided with a plurality of holes 50 which conform to the internal cross-sectional configuration of the loading columns 28. The tray 36A functions in the same way as the tray 42 except that, as will be described in more detail subsequently, to unload a segment utilizing the tray of FIG. 6, the tray must be completely removed from between the segments whereas the tray of FIGS. 7 and 8 need be moved only a distance equal half the spacing between adjacent rows of loading columns 28. It can be seen in FIG. 8, as an example, that if the tray 36A is moved from the closed position illustrated a slight distance, the holes 50 will align with the loading column 28.

Figure 9:
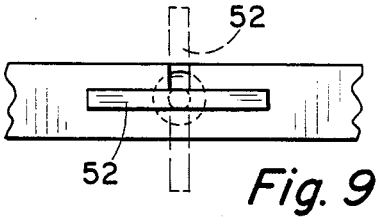
FIG. 9 is a fragmentary rear elevational view of the tray of FIG. 6 or FIG. 7 showing the locking means for retaining the tray in the closed position. The locking means is shown in solid outline in the position in which the tray can be moved from one position to another and in dashed outline for the position in which the locking member is in the locked position preventing the tray from being moved from the closed to the open position.

Each of the trays is provided with a means to prevent it from being inadvertently moved from the closed to the open position. The means whereby this is achieved is illustrated with reference particularly to FIGS. 2, 6, 9 and 10. Extending from the rear surface 40 of each tray is a T-shaped tab 52. This tab is received in a slotted opening 54 (See FIGS. 2 and 4) formed in the rearward end of each segment. The T-shaped tab 52 may be rotated 90° as illustrated in FIG. 9. When the tray is moved from the open to the closed position, the tab 52 extends through the slot 54. Thereafter, the tab may be rotated 90° to the dashed position shown in FIG. 9 which will lock the tray in the closed position.

Figure 10:
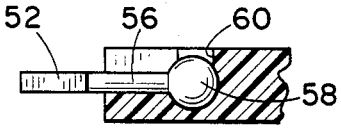
FIG. 10 is a cross-sectional view of a portion of the tray taken along the line 10—10 of FIG. 6.

FIG. 10 shows an arrangement of the T-shaped tab having an integral stem 56 and integral ball portion 58, the ball portion being received in a notch 60 formed in the tray 36 adjacent the rearward edge 40, the ball permitting the T-shaped head to be freely rotated from the closed to the open position.

Application of the Shipping Container of This Invention

After the shipping container has been assembled as illustrated in FIGS. 1 and 2, it is ready to receive articles, such as glass bottles, for storage or transportation. To load the container the bottommost tray 42, or bottommost trays if dual trays are employed as illustrated in FIGS. 1 and 2, are moved to the closed position, that is, wherein the loading columns are closed off. All of the trays 42 above the lowermost tray are maintained in the open position, that is wherein the columns 28 are unobstructed. If solid trays of FIG. 6 are employed, the lowermost trays are inserted, and those above are completely removed from the container, whereas if trays of FIGS. 7 and 8 are used, the trays are merely moved until all except for the lowermost trays have the openings 50 in alignment with the loading columns 28. Articles, such as bottles, may then be inserted into each of the loading columns 28 through the open top of the container. After each of the columns 28 is filled in the lowermost segment of the container, the trays next adjacent and above the lowermost trays are moved to the closed position and the sequence is repeated until the second segment is filled. This sequence is continued until all of the columns in each segment are filled after which the top most tray is moved to the closed position. All the trays can then be locked in the closed position. The container can be moved by a fork lift truck. For this purpose, the lowermost segment as illustrated in FIG. 1 and 2 is provided with openings 62 to receive the tines of a fork lift truck.

The shipping container of this invention is preferably unloaded over a moving padded conveyor belt. To remove the contents, the container is positioned over the moving padded conveyor belts and raised above the belt so that the bottom surface 16 is at an elevation above the belt approximately one-half the height of the bottle or other article stored in the container. The lowermost tray 42 is moved to the open position, allowing the articles to drop from the bottommost segment 24. The bottles fall out and engage the padded conveyor belt and are free to bounce momentarily up and down within the lower portion of the columns within the lowermost segment.

Immediately thereafter the entire container can be elevated, permitting the articles to be moved by the conveyor belt away from underneath the container. Thereafter, the container is lowered again and the trays immediately above the bottommost trays are moved to the open position allowing the contents of the second segment to fall downwardly through the columns onto the conveyor belt. After they have been permitted to bounce momentarily the container is raised again allowing these articles to be moved from underneath the container. This sequence is repeated until the contents of each segment 24 of the entire container are emptied. Thereafter the container may be returned for reuse as many times as is necessary.

The container of the invention provides a means of shipping fragile articles, such as glass bottles, in substantially complete safety against damage in handling or transportation and provides a container which is not only reuseable but which is economical of construction. Further, the container makes possible an automated system for unloading, and loading fragile articles.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A shipping container for fragile articles, such as glass bottles or other articles of uniform size and height, comprising;

an upright structure of generally rectangular horizontal cross-sectional configuration having a bottom, a top, a front, a back and two sides, the structure having internal partitions providing a plurality of vertical loading columns extending from the bottom to the top, the structure having spaced apart horizontal slots therein extending from the front to adjacent the back of the structure, there being a top slot, a bottom slot and intermediate slots, the spacing between the slots being slightly greater than the height of the articles for which the container is configured; and a plurality of trays each having front, back and side edges, and there being a tray for each said slot, the trays being dimensioned to be slidably received from the front of the container in each slot and when in place in closed position in the container to close said plurality of columns, whereby the container may be loaded by closing the bottommost/-tray and inserting an article in each column at the container top so that there is then an article in each column in contact with the bottom tray, after which the tray in the slot next adjacent above the bottommost slot is closed and articles inserted into the top of each columnn to fill the space in each column immediately above the second tray, and the process is repeated until the structure is filled with articles, each of said trays being formed of planar material having holes therethrough conforming in geometrical arrangement to said loading columns and configured such that when a tray is in closed position the openings are out of alignment with said columns but when each tray is moved to the open position the holes therein are in alignment with said columns to permit articles resting thereon to fall through the holes and into the columns below the tray.

2. A shipping container according to claim 1 including means to releasably lock each said tray in closed position within said structure.

3. A shipping container according to claim 1 wherein said structure is formed of a plurality of horizontal segements, each segment providing a portion of said front, back and two sides of said structure and being of a height slightly greater than the height of the articles for which the container is designed, each segment having said internal partitions therein providing vertical loading columns; and means to retain said horizontal segments in stacked alignment.

4. A shipping container according to claim 3 wherein each of said horizontal segments is made of molded plastic.

5. A shipping container according to claim 3 wherein said means to retain said horizontal segments in stacked alignment includes a plurality of elongated bolts extending from the bottom to the top of said stacked segments.

6. A shipping container according to claim 2 wherein each said tray has a rearward edge and wherein said means to releaseably lock each tray in position within said structure includes:

a rotatable T-shaped tab extending from each said tray rearward edge and wherein said structure has an elongated slot for each tray which slidably receives the T-shaped tab at each said tray when said tab is in a position permitting the tray attached thereto to be removed and including means permitting each T-shaped tabs to be manually rotated to an attitude of misalignment with said structure elongated slot to prevent the trays from being removed.

7. A shipping container according to claim 3 wherein the lowermost of said horizontal segments includes spaced apart openings adjacent said structure bottom for receiving fork lift truck tines therein.

8. A shipping container according to claim 1 wherein said structure includes a recess in said front for each said tray, and an opening in each said tray adjacent the front edge which opening may be manually engaged to permit each tray to moved from the open to the closed position and vice versa, and wherein when each said tray when in the closed position does not extend beyond the front of said structure.

* * * * *